US009090953B2

(12) United States Patent
Coffin et al.

(10) Patent No.: US 9,090,953 B2
(45) Date of Patent: Jul. 28, 2015

(54) METHODS FOR REDUCING IMPURITIES IN MAGNESIUM, PURIFIED MAGNESIUM, AND ZIRCONIUM METAL PRODUCTION

(75) Inventors: Scott Coffin, Albany, OR (US); Arnel M. Fajardo, Beaverton, OR (US)

(73) Assignee: ATI Properties, Inc., Albany, OR (US)

( * ) Notice: Subject to any disclaimer, the term of this patent is extended or adjusted under 35 U.S.C. 154(b) by 447 days.

(21) Appl. No.: 13/585,094

(22) Filed: Aug. 14, 2012

(65) Prior Publication Data

US 2014/0050608 A1 Feb. 20, 2014

(51) Int. Cl.

| | |
|---|---|
| ***C22B 26/22*** | (2006.01) |
| ***C22B 9/10*** | (2006.01) |
| ***C22B 34/14*** | (2006.01) |
| ***C22C 23/00*** | (2006.01) |

(52) U.S. Cl.
CPC . *C22B 9/10* (2013.01); *C22B 26/22* (2013.01); *C22B 34/14* (2013.01); *C22C 23/00* (2013.01)

(58) Field of Classification Search
CPC ..... C22B 26/22
USPC ..... 75/604
See application file for complete search history.

(56) References Cited

U.S. PATENT DOCUMENTS

| | | | | |
|---|---|---|---|---|
| 2,779,672 | A | 1/1957 | Chisholm et al. | |
| 4,511,399 | A | 4/1985 | Kwon et al. | |
| 4,668,287 | A | 5/1987 | Kwon | |
| 4,891,065 | A | 1/1990 | Green et al. | |
| 5,147,450 | A * | 9/1992 | Mikucki et al. | 75/601 |
| 5,804,138 | A | 9/1998 | Earlam | |

FOREIGN PATENT DOCUMENTS

| | | |
|---|---|---|
| GB | 591225 | 8/1947 |
| GB | 730008 | 5/1955 |
| JP | 2-47237 A | 2/1990 |
| SU | 390175 | 7/1973 |

OTHER PUBLICATIONS

Babkin, V. M., "Solubility of Zirconium in Liquid Magnesium and the ML5 Alloy", Metallovedenie i Termicheskaya Obrabotka Metallov, No. 3, Mar. 1968, pp. 61-64.

Brace, A. W. And F. A. Allen, Magnesium Casting Technology, Reinhold Publishing Corporation, New York, Feb. 7, 1957, pp. 31-33.

* cited by examiner

*Primary Examiner* — Brian Walck

(74) *Attorney, Agent, or Firm* — K & L Gates LLP; John E. Grosselin, III

(57) ABSTRACT

A method for reducing impurities in magnesium comprises: combining a zirconium-containing material with a molten low-impurity magnesium including no more than 1.0 weight percent of total impurities in a vessel to provide a mixture; holding the mixture in a molten state for a period of time sufficient to allow at least a portion of the zirconium-containing material to react with at least a portion of the impurities and form intermetallic compounds; and separating at least a portion of the molten magnesium in the mixture from at least a portion of the intermetallic compounds to provide a purified magnesium including greater than 1000 ppm zirconium. A purified magnesium including at least 1000 ppm zirconium and methods for producing zirconium metal using magnesium reductant also are disclosed.

47 Claims, 3 Drawing Sheets

METHODS FOR REDUCING IMPURITIES IN MAGNESIUM, PURIFIED MAGNESIUM, AND ZIRCONIUM METAL PRODUCTION

FIELD OF TECHNOLOGY

The present disclosure relates to methods for reducing impurities in magnesium. The present disclosure also relates to a purified magnesium. The present disclosure further relates to a method for making zirconium metal using magnesium as a reducing agent.

BACKGROUND OF THE INVENTION

The predominant market for magnesium metal currently is in the alloying of aluminum. The strength and light weight of certain magnesium-containing aluminum alloys makes the alloys well suited for use in various aerospace, automotive, and electronic components. Magnesium metal also is commonly used as a desulfurization agent in processes for refining ferrous metals, as well as in the production of titanium and zirconium metal. In the well-known Kroll process for producing titanium metal, $TiCl_4$ is reduced to titanium metal by reaction with an excess of liquid magnesium at high temperature according to the following equation:

$$2Mg(l)+TiCl_4(g)\rightarrow 2MgCl_2(l)+Ti(s)$$

The magnesium chloride product can be further refined back to magnesium. The porous metallic titanium sponge produced in the reduction process may be purified by leaching or heated vacuum distillation.

Since the 1950's, the industrial production of zirconium metal has principally relied on the use of magnesium as a reducing agent. In typical zirconium metal production methods, approximately one part of magnesium (by weight) is required as a reducing agent to yield one part of zirconium metal sponge from zirconium (IV) chloride (i.e., zirconium tetrachloride) according to a well-known adaptation of the Kroll reduction process. Given the significant amount of magnesium required in the Kroll process per unit zirconium metal produced, at least a portion of any impurities present in the magnesium will be incorporated into the zirconium product. Therefore, it is important to carefully control the quality of magnesium used in the Kroll process in order to produce a highly pure zirconium product.

Impurities that are of concern in zirconium production include, for example, iron, aluminum, and nitrogen, and all of these elements may be present as impurities in a magnesium reductant. Iron is a common material used in the construction of magnesium refining equipment, and although iron has a relatively low solubility in molten magnesium (approximately 0.12 weight percent at 800° C.), this impurity level still represents a significant potential contributor to iron impurities in zirconium metal produced by the Kroll process. Aluminum contamination in magnesium reductant may originate from aluminosilicates entrained in brines used as starting material in magnesium production. Nitrogen impurities can form in magnesium when liquid magnesium contacts ambient air and, despite cover gases used in the course of magnesium refining, significant opportunities exist for this mode of nitrogen contamination.

Zirconium production, unlike many other processes in which magnesium is used, requires meeting strict limits on the levels of impurities. Top-quality zirconium metal is highly pure and unalloyed with other elements, and achieving this level of purity demands judicious management of starting materials. As examples, top-quality zirconium includes less than 1000 ppm iron and less than 100 ppm aluminum. As new alloys are developed and as zirconium customers seek to improve their products over time, the impurities limits for zirconium are expected to become even more restrictive. Nitrogen is an especially deleterious impurity in zirconium because it forms nitrides with zirconium. Excessive nitrogen can lead to large zirconium nitride regions, which are insoluble during zirconium melting and may significantly reduce product quality. Zirconium nitride inclusions in a cast zirconium metal are relatively hard regions and can be the source of voids or cracks as the zirconium metal is worked.

Accordingly, it would be advantageous to provide a method for reducing impurities in magnesium used as a reductant in the production of zirconium metal by the Kroll process, thereby improving the purity of the zirconium metal product. More generally, it would be advantageous to provide an improved method for reducing impurities in magnesium provided for any end use.

SUMMARY OF THE PRESENT INVENTION

An aspect of the present disclosure is directed to methods for reducing impurities in magnesium. The methods include combining a zirconium-containing material with a molten low-impurity magnesium including no more than 1.0 weight percent of total impurities in a vessel to provide a mixture. The mixture is held in a molten state for a period of time sufficient to allow at least a portion of the zirconium-containing material to react with at least a portion of the impurities and form intermetallic compounds. At least a portion of the molten magnesium in the mixture is separated from at least a portion of the intermetallic compounds to provide a purified magnesium. The purified magnesium includes an increased level of zirconium compared to the low-impurity magnesium, and the zirconium level in the purified magnesium is greater than 1000 ppm. The purified magnesium also includes a reduced level of impurities other than zirconium compared to the low-impurity magnesium.

Another aspect of the present disclosure is directed to methods for reducing impurities in magnesium. The methods comprise combining at least one zirconium-containing material selected from zirconium metal, zirconium tetrachloride, zirconium oxide, zirconium nitride, zirconium sulfate, zirconium tetrafluoride, $Na_2ZrCl_6$, and $K_2ZrCl_6$ with a molten low-impurity magnesium including no more than 1.0 weight percent of total impurities in a vessel to provide a mixture. The mixture is held in a molten state for at least 30 minutes to allow at least a portion of the zirconium-containing material to react with at least a portion of the impurities and form intermetallic compounds. At least a portion of the molten magnesium in the mixture is separated from at least a portion of the intermetallic compounds to provide a purified magnesium, wherein the purified magnesium includes a reduced level of impurities other than zirconium compared to the low-impurity magnesium and includes greater than 1000 ppm zirconium.

A further aspect according to the present disclosure is directed to a purified magnesium consisting essentially of greater than 1000 up to 3000 ppm zirconium, magnesium, and incidental impurities. In one non-limiting form, the purified magnesium consists essentially of: greater than 1000 up to 3000 ppm zirconium; magnesium; 0 to 0.007 weight percent aluminum; 0 to 0.0001 weight percent boron; 0 to 0.002 weight percent cadmium; 0 to 0.01 weight percent hafnium; 0 to 0.06 weight percent iron; 0 to 0.01 weight percent manganese; 0 to 0.005 weight percent nitrogen; 0 to 0.005 weight percent phosphorus; and 0 to 0.02 weight percent titanium.

Yet a further aspect according to the present disclosure is directed to methods of producing zirconium metal. The methods include: reacting zirconium tetrachloride with magnesium reductant comprising greater than 1000 up to 3000 ppm zirconium to provide reaction products comprising zirconium metal and magnesium chloride salt; and separating at least a portion of the zirconium metal from the reaction products. In certain embodiments of the method, the magnesium reductant consists essentially of: greater than 1000 up to 3000 ppm zirconium; magnesium; 0 to 0.007 weight percent aluminum; 0 to 0.0001 weight percent boron; 0 to 0.002 weight percent cadmium; 0 to 0.01 weight percent hafnium; 0 to 0.06 weight percent iron; 0 to 0.01 weight percent manganese; 0 to 0.005 weight percent nitrogen; 0 to 0.005 weight percent phosphorus; and 0 to 0.02 weight percent titanium.

The reader will appreciate the foregoing details and advantages of the present invention, as well as others, upon considering the following detailed description of certain non-limiting embodiments of the invention. The reader also may comprehend such additional details and advantages of the present invention upon making and/or using embodiments within the present invention.

BRIEF DESCRIPTION OF THE FIGURES

The features and advantages of the present invention may be better understood by reference to the accompanying figures in which.

DESCRIPTION OF NON-LIMITING EMBODIMENTS OF THE INVENTION

Figure 1:
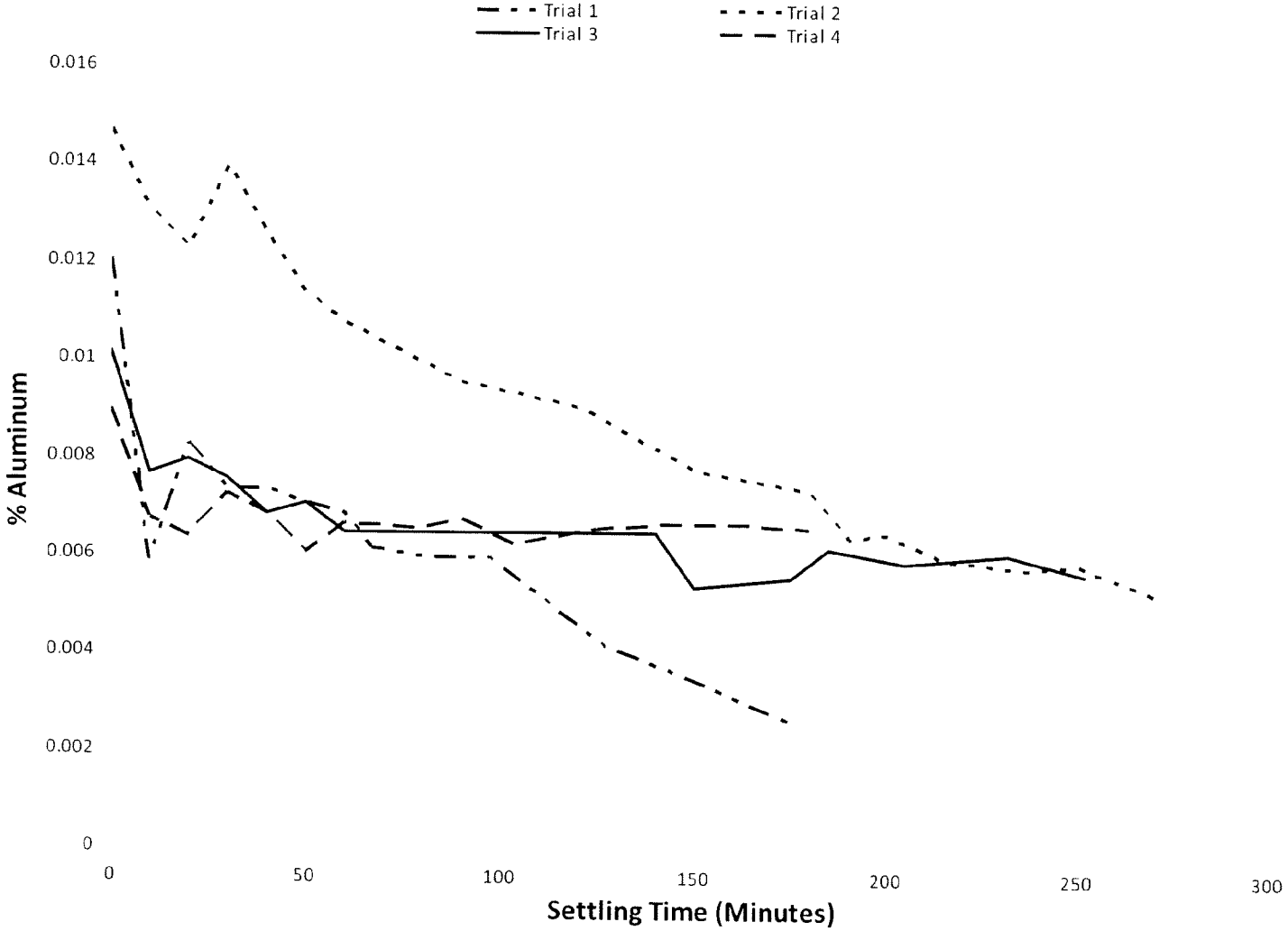
FIG. 1 is a graph plotting aluminum content (weight percent) of magnesium as a function of settling time for certain magnesium purification trials discussed herein.

Various embodiments are described and illustrated in this specification to provide an overall understanding of the steps and use of the disclosed methods. It is understood that the various embodiments described and illustrated in this specification are non-limiting and non-exhaustive. Thus, the invention is not limited by the description of the various non-limiting and non-exhaustive embodiments disclosed in this specification. In appropriate circumstances, the features and characteristics described in connection with various embodiments may be combined with the features and characteristics of other embodiments. Such modifications and variations are intended to be included within the scope of this specification. As such, the claims may be amended to recite any steps, limitations, features, and/or characteristics expressly or inherently described in, or otherwise expressly or inherently supported by, this specification. Further, Applicants reserve the right to amend the claims to affirmatively disclaim steps, limitations, features, and/or characteristics that are present in the prior art regardless of whether such features are explicitly described herein. Therefore, any such amendments comply with the requirements of 35 U.S.C. §112, first paragraph, and 35 U.S.C. §132(a). The various embodiments disclosed and described in this specification can comprise, consist of, or consist essentially of the steps, limitations, features, and/or characteristics as variously described herein.

Any patent, publication, or other disclosure material identified herein is incorporated by reference into this specification in its entirety unless otherwise indicated, but only to the extent that the incorporated material does not conflict with existing definitions, statements, or other disclosure material expressly set forth in this specification. As such, and to the extent necessary, the express disclosure as set forth in this specification supersedes any conflicting material incorporated by reference herein. Any material, or portion thereof, that is said to be incorporated by reference into this specification, but which conflicts with existing definitions, statements, or other disclosure material set forth herein, is only incorporated to the extent that no conflict arises between that incorporated material and the existing disclosure material. Applicants reserve the right to amend this specification to expressly recite any subject matter, or portion thereof, incorporated by reference herein.

The grammatical articles "one", "a", "an", and "the", if and as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

Various embodiments disclosed and described in this specification are directed to methods for reducing the content of impurities in magnesium. One non-limiting application discussed herein for a purified magnesium metal produced using embodiments of the methods described herein is as a reductant in a Kroll process for producing zirconium metal. However, it will be understood that magnesium purified according to the present methods may be used in any other suitable application. As used herein, the phrase "purified magnesium" and like phrases refer to a magnesium including a reduced level of impurities relative to some prior state, and such phrases are not necessarily limited to a magnesium that is devoid of impurities.

In many processes in which magnesium is used, high-purity magnesium is not required. For example, a high-purity magnesium is not currently required for iron desulfurization processes and aluminum alloying applications, where iron and aluminum contaminants, respectively, in the magnesium are understandably of lesser concern. Even in processes in which magnesium is used as a reductant for producing titanium metal, conventional impurities targets for the magnesium are typically met by standard practices for refining magnesium. In certain other processes, however, there is a requirement for magnesium that includes no more than very low levels of impurities.

U.S. Pat. No. 2,779,672 describes a method of purifying molten magnesium with titanium tetrachloride ($TiCl_4$). By bubbling approximately 1 part of $TiCl_4$ into 53 parts of liquid magnesium and allowing for subsequent settling, an iron content of 20 ppm is achieved within the magnesium. This compares with an initial iron content of 270 ppm in the magnesium. Reduction in manganese and aluminum impurities using this treatment also was reported. Despite these reductions in impurities, the process also produced a sixfold increase in the level of titanium impurities, from 40 ppm to 240 ppm. Titanium is tracked as an impurity in zirconium metal production, with a customary upper limit that typically is much less than 100 ppm. Thus, magnesium prepared by the method of the U.S. '672 patent may be unsuitable for use as a reductant for zirconium metal production. Nitrogen also is tracked as an impurity in zirconium production, and the process of the U.S. '672 patent does not address the reduction of nitrogen impurities in magnesium.

Although the present methods conventionally used for refining and casting magnesium do not involve the addition of zirconium or zirconium compounds, a method has been described in the literature in which a zirconium compound is used in magnesium refining. Great Britain Patent No. 591,225 teaches a method for purifying magnesium alloy through the addition of zirconium compounds. In an embodiment of the process described in the '225 patent, the iron content in a magnesium alloy including 1-12% aluminum is reduced from 410 ppm to 45 ppm through the addition of a mixture of sodium chloride and zirconium tetrachloride to the magnesium. The '225 patent suggests that the quantity of zirconium compound added to the magnesium is not critical, so long as it exceeds the quantity of iron present in the initial magnesium melt. The final content of zirconium in the purified magnesium alloy was reported to be below detection. The '225 patent, however, does not teach any reduction in, for example, nitrogen content in the magnesium by addition of the zirconium tetrachloride.

The reported absence of zirconium in the final cast magnesium product produced in the '225 patent is noteworthy given that zirconium is used as a grain refiner for magnesium metal. Without intending to be bound to any particular theory, it is believed that two factors may be responsible for the absence of zirconium in solution in the magnesium product in the '225 patent. First, it is known that zirconium solubility in magnesium decreases as alloying aluminum is added. See, e.g., V. M. Babkin, *Metallovedenie I Termicheskaya Obrabotka Metallov* 1968, 3, pp. 61-64. The alloy of the '225 patent generally includes 3-12% aluminum, thereby reducing zirconium solubility. Second, intermetallic compounds such as $ZrAl_3$, $Zr_3Al_4$, and $ZrAl_3$ consume much of the zirconium compound added to the magnesium in the '225 patent, which prevents zirconium from purifying the alloy. In either case, the present inventors believe that the efficacy of zirconium as a purifying agent is significantly limited in the method of the '225 patent due to the presence of alloying aluminum in the magnesium alloy. In the method of the present invention, the magnesium that is to be purified preferably includes no more than 0.02 weight percent aluminum.

As discussed above, the presence of certain alloying elements such as, for example, aluminum, in magnesium used as reductant can totally or partially reduce the effectiveness of a zirconium purification protocol. The prior art techniques for purifying magnesium provide no more than insufficient guidance because they do not widely address the potentially problematic impurities elements in magnesium. In addition, especially given the increasingly stringent purity targets for zirconium metal, the presence of more than very minor levels of aluminum and/or other elements in a magnesium reductant for zirconium production can be unsuitable because the other elements may become incorporated as impurities in the zirconium final product.

According to the present disclosure, methods for purifying a low-impurity magnesium are disclosed. As used herein, a "low-impurity magnesium" means magnesium including no more than a total of 1.0 weight percent of elements other than magnesium. In certain preferred embodiments, the magnesium may include no more than 0.5 weight percent, or more preferably not more than 0.3 weight percent of other elements. The other elements, which may be referred to herein as "impurities" in the magnesium, may include, but are not necessarily limited to, aluminum, iron, manganese, nitrogen, phosphorus, and titanium. The initial concentration of aluminum in the low-impurity magnesium preferably is no greater than 0.02 weight percent. A starting aluminum content greater than 0.02 weight percent may lengthen the settling time and/or increase the dosage amount of the zirconium-containing material for the method of the present disclosure.

In certain non-limiting embodiments, a purified magnesium processed according to the magnesium method of the present disclosure includes no more than 0.10 weight percent of elements other than magnesium and zirconium. Various impurities elements, if present in a non-limiting embodiment of a purified magnesium made according certain non-limiting embodiments of methods of the present disclosure, may be present in the purified magnesium in concentrations that do not exceed the following permissible levels:

Aluminum: no more than 0.007 weight percent; preferably no more than 0.005 weight percent; and more preferably no more than 0.004 weight percent.

Boron: no more than 0.0001 weight percent; preferably no more than 0.00007 weight percent; and more preferably no more than 0.00005 weight percent.

Cadmium: no more than 0.002 weight percent; preferably no more than 0.0001 weight percent; and more preferably no more than 0.00005 weight percent.

Hafnium: no more than 0.01 weight percent; preferably no more than 0.005 weight percent; and more preferably no more than 0.003 weight percent.

Iron: no more than 0.06 weight percent; preferably no more than 0.04 weight percent; and more preferably no more than 0.03 weight percent.

Manganese: no more than 0.01 weight percent; preferably no more than 0.008 weight percent; and more preferably no more than 0.006 weight percent.

Nitrogen: no more than 0.005 weight percent; preferably no more than 0.004 weight percent; and more preferably no more than 0.003 weight percent.

Phosphorus: no more than 0.005 weight percent; preferably no more than 0.004 weight percent; and more preferably no more than 0.003 weight percent.

Titanium: no more than 0.02 weight percent; preferably no more than 0.01 weight percent; and more preferably no more than 0.005 weight percent.

One non-limiting embodiment of a purified magnesium made according certain non-limiting embodiments of methods of the present disclosure includes: no more than 0.007 weight percent aluminum; no more than 0.0001 weight percent boron; no more than 0.002 weight percent cadmium; no more than 0.01 weight percent hafnium; no more than 0.06 weight percent iron; no more than 0.01 weight percent manganese; no more than 0.005 weight percent nitrogen; no more than 0.005 weight percent phosphorus; and no more than 0.02 weight percent titanium. Non-limiting embodiments of such a purified magnesium also include greater than 1000 ppm zirconium, or in other embodiments include greater than 1000 ppm up to 3000 ppm zirconium.

Although the levels of various impurities elements should be strictly limited, as discussed above, in magnesium used in various applications, including use as a reductant for producing zirconium metal, the present inventors concluded that the level of zirconium impurity in magnesium need not be restricted if the magnesium is to be used as reductant to produce zirconium metal from zirconium tetrachloride in a Kroll process. Indeed, as illustrated further below, the presence of zirconium in a magnesium product that has been processed to reduce impurities according to the methods of the present disclosure is a positive indicator that impurities elements such as, for example, aluminum, iron, and nitrogen, are not present in the magnesium product in levels exceeding allowable limits. Magnesium purified according to the methods of the present disclosure including retained zirconium may be used as reductant in zirconium metal production largely without any negative impact on the purity of the zirconium metal end product. In addition, such magnesium may be used in other applications in which the presence of zirconium in the magnesium is not problematic.

One potential issue that may be problematic regarding the presence of zirconium in magnesium produced by a purification process according to the methods herein is that hafnium may be associated with the zirconium. Hafnium is commonly naturally commingled with zirconium in zircon ores. The natural concentration of hafnium in zirconium is typically 1-4 weight percent, with a common value of about 2.3 weight percent, and this concentration may be sufficient to detract materially from required zirconium purity for certain uses of the metal. For example, separation of hafnium from zirconium is an indispensable process step in the manufacture of zirconium for nuclear applications. If, for example, a 1000 ppm dose of zirconium including a typical commingled level of hafnium is present in magnesium used as a reductant in zirconium metal production, about 23 ppm of hafnium may be present in the final cast zirconium product. Nuclear-grade zirconium can include no more than very minor levels of hafnium and, for example, the addition of even 23 ppm hafnium could jeopardize the success of meeting the typical purity standards for nuclear-grade zirconium metal. If magnesium purified according to methods of the present disclosure will be used as reductant to make nuclear-grade zirconium metal, zirconium and or zirconium compounds used to purify the magnesium preferably are nuclear-grade or otherwise have been processed to separate hafnium from the zirconium.

According to embodiments of methods of the present disclosure for increasing purity of magnesium, at least one zirconium-containing material is added to a molten low-impurity magnesium in a holding vessel before the molten magnesium is cast. As used herein a "zirconium-containing material" is one of zirconium metal and a zirconium-based compound. As used herein, a "zirconium-based compound" means a compound that includes one or more metallic elements and one or more non-metallic elements, and wherein the metallic elements may consist only of zirconium or may include more than 90% zirconium by weight. According to one non-limiting embodiment of the methods herein, the zirconium-based compound is zirconium tetrachloride, which preferably is a nuclear-grade zirconium tetrachloride. Additional examples of zirconium-based compounds that may be used in embodiments of the methods according to the present disclosure include zirconium oxide, zirconium nitride, zirconium sulfate, zirconium tetrafluoride, and the chlorozirconate salts, $Na_2ZrCl_6$ and $K_2ZrCl_6$.

Usage of zirconium oxide, zirconium nitride, and zirconium sulfate as a zirconium-based compound in magnesium purification methods according to the present disclosure may not be preferred because decomposition of these compounds within molten magnesium may yield oxygen and/or nitrogen impurities. Localized areas of high oxygen and/or nitrogen in a purified magnesium product used as reductant in zirconium metal production, for example, may cause the final zirconium sponge to contain high-density inclusions, which can adversely affect the physical integrity of zirconium metal product. Usage of zirconium tetrafluoride as the zirconium-based compound, on the other hand, would not lead to oxygen or nitrogen impurities in the purified magnesium product. However, zirconium tetrafluoride forms high-melting magnesium fluoride ($MgF_2$) in the presence of molten magnesium. The melting point of magnesium fluoride is about 1263° C., which is substantially higher than the melting point of magnesium (650° C.) and of magnesium chloride (714° C.). Magnesium fluoride may coat zirconium tetrafluoride particles, inhibiting further reaction with and incorporation into molten magnesium, and thus zirconium tetrafluoride represents a less preferred option than does zirconium tetrachloride. Downstream chloride inclusions in a zirconium metal product produced using magnesium reductant purified with zirconium tetrachloride according to the present disclosure pose lower risk to the zirconium metal product because magnesium chloride salt is removed during the conventional vacuum distillation step of zirconium sponge production. The chlorozirconate salts, $Na_2ZrCl_6$ and $K_2ZrCl_6$, may be less preferable than zirconium tetrachloride because the two salts must be produced from nuclear-grade zirconium tetrachloride and require higher costs to purify.

The holding vessel may be any container suitable for reacting the materials when conducting the methods herein. In various non-limiting embodiments, suitable holding vessels include, for example, covered or uncovered mild steel tanks. In certain embodiments, the steel tanks may have liquid capacities of at least 1000 gallons, or in certain embodiments 1000 to 1500 gallons, or more. Certain holding vessels may be adapted for dispensing molten magnesium into a mold or other casting element or apparatus once the magnesium has been processed according to a method of the present disclosure.

Following the addition of the zirconium-containing material, the mixture comprising the low-impurity magnesium and the zirconium and/or zirconium-based compound is maintained in a molten state for a period of time sufficient for the zirconium added to the molten low-impurity magnesium to react with impurities in the magnesium, as well as for intermetallic compounds produced by reaction between zirconium and impurities in the mixture to settle to a bottom region of the holding vessel. In certain non-limiting embodiments of the method, the time required for the reactions to occur to a sufficient degree and to allow intermetallic compounds to settle to the bottom region of the holding vessel is at least 30 minutes. Also, in certain non-limiting embodiments of the method, the time for reaction and settling is in the range of 30 minutes to 100 minutes. Those having ordinary skill, on reading the present disclosure, without undue effort may determine a period of time sufficient for reaction and settling to occur for a particular embodiment of the present method. The minimum period required for reaction and settling of produced intermetallic compounds will be influenced by factors such as, for example: the volume and temperature of molten low-impurity magnesium being treated; the nature and concentration of impurities in the molten magnesium; the identity and concentration of zirconium and/or zirconium compound used to purify the magnesium; and the mixing kinetics within the holding vessel, which influences the movement of reactant within the mass of molten magnesium. Those having ordinary skill, on reading the present disclosure, may without undue effort determine a period of time sufficient for reaction and settling to occur for a particular embodiment of the present methods under the particular conditions present.

According to one non-limiting embodiment of a method for purifying magnesium, a dose of a zirconium-containing compound in the form of zirconium tetrachloride, and preferably a nuclear-grade zirconium tetrachloride, is introduced into a molten low-impurity magnesium in a holding vessel. The zirconium tetrachloride in solid form may be introduced directly into the molten magnesium. In such embodiments, it is not necessary to pre-heat the zirconium tetrachloride. In certain other embodiments, zirconium may be added to molten low-impurity magnesium in the form of zirconium metal, and preferably nuclear-grade zirconium metal. According to one non-limiting embodiment, the composition of a "nuclear-grade" zirconium metal meets the impurity level limits listed in Table 1, which were established by the Minor Metals Trade Association (MMTA):

TABLE 1

| Element | Level | Unit |
|---|---|---|
| Zr + Hf | 99.5 | wt. % minimum |
| Hf | 100 | ppm maximum |
| C | 250 | ppm maximum |
| O | 1400 | ppm maximum |
| N | 50 | ppm maximum |
| Cl | 1300 | ppm maximum |
| Al | 75 | ppm maximum |
| B | 0.5 | ppm maximum |
| Cd | 0.5 | ppm maximum |
| Co | 20 | ppm maximum |
| Cu | 30 | ppm maximum |
| Cr | 200 | ppm maximum |
| Fe | 1500 | ppm maximum |
| Mn | 50 | ppm maximum |
| Mo | 50 | ppm maximum |
| Ni | 70 | ppm maximum |
| Si | 120 | ppm maximum |
| Ti | 50 | ppm maximum |
| W | 50 | ppm maximum |
| U | 3 | ppm maximum |

Therefore, according to one embodiment of the methods of the present disclosure, the zirconium-containing material is or includes a nuclear-grade zirconium that comprises: at least 99.5 weight percent zirconium; 0 to 100 ppm hafnium; 0 to 250 ppm carbon; 0 to 1400 ppm oxygen; 0 to 50 ppm nitrogen; 0 to 1300 ppm chlorine; 0 to 75 ppm aluminum; 0 to 0.5 ppm boron; 0 to 0.5 cadmium ppm; 0 to 20 ppm cobalt; 0 to 30 ppm copper; 0 to 200 ppm chromium; 0 to 1500 ppm iron; 0 to 50 ppm manganese; 0 to 50 ppm molybdenum; 0 to 70 ppm nickel; 0 to 120 ppm silicon; 0 to 50 ppm titanium; 0 to 50 ppm tungsten; and 0 to 3 ppm uranium.

There is no industry standard for what constitutes "nuclear-grade" zirconium chloride salt. However, in certain embodiments of the methods according the present disclosure, the zirconium-containing material is or includes a nuclear-grade zirconium tetrachloride that comprises the following levels of impurities, wherein the impurities concentrations are calculated relative to the zirconium content in the zirconium tetrachloride: 0 to 100 ppm hafnium; 0 to 250 ppm carbon; 0 to 1400 ppm oxygen; 0 to 50 ppm nitrogen; 0 to 75 ppm aluminum; 0 to 0.5 ppm boron; 0 to 0.5 cadmium ppm; 0 to 20 ppm cobalt; 0 to 30 ppm copper; 0 to 200 ppm chromium; 0 to 1500 ppm iron; 0 to 50 ppm manganese; 0 to 50 ppm molybdenum; 0 to 70 ppm nickel; 0 to 120 ppm silicon; 0 to 50 ppm titanium; 0 to 50 ppm tungsten; and 0 to 3 ppm uranium.

In non-limiting embodiments of the methods herein, a solid zirconium or zirconium-based compound used in the methods may be in the form of a fine particulate material, a powder, turnings, foil, or another form presenting a relatively large surface area to volume. Such forms reduce the time necessary to melt the zirconium-containing material in the molten magnesium and disperse the material through the magnesium, thereby facilitating reaction of the zirconium with impurities in the molten magnesium. In certain embodiments of the methods herein, the zirconium or zirconium-based compound is in the form of particles less than 80 mesh in size and is anhydrous and free-flowing, to facilitate rapid dispersal within the molten magnesium. Other suitable forms for zirconium and zirconium-based compounds used in the methods herein will be apparent to those having ordinary skill upon reading the present disclosure.

One non-limiting embodiment of a method for reducing impurities in a low-impurity magnesium according to the present disclosure includes combining at least one zirconium-containing material selected from zirconium metal, zirconium tetrachloride, zirconium oxide, zirconium nitride, zirconium sulfate, zirconium tetrafluoride, $Na_2ZrCl_6$, and $K_2ZrCl_6$ with a molten low-impurity magnesium including no more than 1.0 weight percent of total impurities in a vessel to provide a mixture. The mixture is held in a molten state for at least 30 minutes to allow at least a portion of the zirconium-containing material to react with at least a portion of the impurities and form intermetallic compounds. At least a portion of the molten magnesium in the mixture is separated from at least a portion of the intermetallic compounds to provide a purified magnesium. The purified magnesium has a reduced level of impurities other than zirconium compared to the low-impurity magnesium and includes greater than 1000 ppm zirconium. In certain non-limiting embodiments of the method, the zirconium-containing material comprises at least one of nuclear-grade zirconium and nuclear-grade zirconium tetrachloride, each of which may have a composition conforming to the impurities restrictions described here. In certain of the method embodiments, the purified magnesium produced by the method includes: no more than 0.007 weight percent aluminum; no more than 0.0001 weight percent boron; no more than 0.002 weight percent cadmium; no more than 0.01 weight percent hafnium; no more than 0.06 weight percent iron; no more than 0.01 weight percent manganese; no more than 0.005 weight percent nitrogen; no more than 0.005 weight percent phosphorus; no more than 0.02 weight percent titanium; and greater than 1000 ppm zirconium, or greater than 1000 ppm up to 3000 ppm zirconium. In certain embodiments of the method, the combining step comprises combining solid powdered zirconium tetrachloride with the molten low-impurity magnesium at a rate of 2 to 3 pounds zirconium tetrachloride per minute to provide the mixture. In certain embodiments of the method, the combining step comprises combining solid powdered zirconium tetrachloride with the molten low-impurity magnesium to provide the mixture comprising 1.0 to 1.7 percent zirconium tetrachloride, based on the initial weight of the molten low-impurity magnesium. In certain embodiments of the method, the combining step comprises combining solid powdered zirconium tetrachloride with the molten low-impurity magnesium to provide the mixture comprising 1.1 to 1.4 percent zirconium tetrachloride, based on the initial weight of the molten low-impurity magnesium According to one non-limiting embodiment of a method for enhancing the purity of a low-impurity magnesium according to the present disclosure, zirconium tetrachloride in the form of a solid powder is added to a molten low-impurity magnesium in a holding vessel at a rate of 2 to 3 pounds per minute. In certain non-limiting embodiments, solid powdered zirconium tetrachloride is added to a molten low-impurity magnesium in a holding vessel to provide a level of zirconium tetrachloride in the mixture between 1.0 and 1.7 percent, and preferably between 1.1 and 1.4 percent, based on the weight of initial molten magnesium. In certain non-limiting embodiments, solid powdered zirconium tetrachloride is added to a molten low-impurity magnesium in a holding vessel at a rate of 2 to 3 pounds per minute to provide a level of zirconium tetrachloride in the mixture between 1.0 and 1.7 percent, and preferably between 1.1 and 1.4 percent, based on the weight of initial molten magnesium. In one particular non-limiting example, 155 pounds of particulate zirconium tetrachloride is added at a rate of 2.5 to 2.6 pounds per minute to a holding vessel including 13,000 pounds of molten low-impurity magnesium. In certain embodiments of the method, the zirconium tetrachloride may be added manually by scooping portions into the magnesium. In a high-volume setting, automated introduction using techniques such as augering of the solid zirconium tetrachloride into the molten magnesium may be used. In either case, in order to penetrate through any layer of flux that may be on the top surface of the molten magnesium within the holding vessel, the zirconium-containing material may be introduced into the molten magnesium using a transfer pipe or other conduit that passes through the flux layer. In cases in which a transfer pipe or other functionally equivalent conduit is used, it may be necessary or expedient to periodically clean the interior volume of the conduit (e.g., "rodding out") to prevent clogging or unintended partial introduction of the zirconium-containing material into the magnesium.

In order to facilitate reaction between the zirconium and the impurities in the molten low-impurity magnesium, conventional stirring/mixing techniques and equipment may be used to enhance homogenization of the mixture of molten low-impurity magnesium and zirconium-containing material (i.e., the "reaction mixture") in the holding vessel. One possible means for enhancing homogeneity of mixtures of molten magnesium and zirconium-containing material produced in the present methods is to induce convection currents within the holding vessel, for example by heating a lower zone and/or cooling an upper zone of the interior volume of the holding vessel. Other possible means for enhancing homogeneity of mixtures of molten magnesium and zirconium-containing material will be apparent to those with ordinary skill upon considering the present disclosure.

Again referring to the non-limiting embodiment discussed above, after zirconium tetrachloride has been added to the molten low-impurity magnesium to achieve a dosage of 1.0 to 1.7 weight percent of zirconium tetrachloride, the mixture may be stirred to improve homogeneity. Stirring facilitates completely dispersing the tetrachloride compound in the molten magnesium. Once the zirconium tetrachloride has been dispensed, fluxing compounds such as, for example, the fluxing compound described in U.S. Pat. No. 5,804,138, containing one or more of potassium chloride, magnesium chloride, and calcium fluoride, may be added to the mixture to suppress oxidation of the magnesium in air. U.S. Pat. No. 5,804,138 is incorporated herein by reference in its entirety. The usage of flux during handling of molten magnesium has been widely practiced and will be readily understood by ordinarily skilled persons. Stirring may be discontinued to allow the mixture to settle for a time. Without intending to be held to any particular theory, it is believed that during the settling period, when the molten mixture is quiescent, binary intermetallics form through reaction of zirconium and impurities in the molten magnesium and settle to a bottom region of the holding vessel. These intermetallics may be, for example, $Zr_4Al_3$ (formed by reaction of zirconium and aluminum), $ZrFe_2$ (reaction of zirconium and iron), and $ZrMn_2$ (reaction of zirconium and manganese). Formation of solid intermetallics is driven by their insolubility within molten magnesium. As the intermetallics particles grow in diameter, they become less prone to physical suspension in solution, and their higher density causes them to sink in the molten magnesium to a bottom region of the holding vessel. An inspissating flux, which is known in the art for use in magnesium purification, also may be added to the mixture to aid in the settling of impurities in the molten magnesium. Inspissating fluxes are described in, for example, A. W. Brace and F. W. Allen, *Magnesium Casting Technology* (Rheinhold Pub. Co., New York, 1957).

Sufficient time should be provided in the present methods so that intermetallics formed settle to the bottom region of the holding vessel, thereby improving the resulting purity of the magnesium product. Absent allowing sufficient time for intermetallics to settle to the bottom region of the holding vessel, the intermetallics may remain suspended in the molten magnesium and become entrained in the magnesium casting. As an example, with respect to a method embodiment wherein zirconium tetrachloride is added to molten low-impurity magnesium to achieve a total dosage of 1.1 to 1.4 weight percent of zirconium tetrachloride in the melt, FIG. 1 plots the aluminum content of the purified magnesium in the holding vessel as a function of time for four experimental trials, Trials 1-4. Aluminum values were obtained by scooping a small sample (roughly 5 to 10 mL) of molten magnesium from the vessel, allowing the metal to solidify, and analyzing the solid metal by glow discharge mass spectrometry (GD-MS). The aluminum content drops as the aluminum-containing intermetallics form and physically separate from the purified molten magnesium by falling to the bottom region of the holding vessel. In FIG. 1, the time scale shown on the X-axis begins at t=0, which is the time at which the zirconium tetrachloride and refining fluxes were added to the molten low-impurity magnesium in the holding vessel. It is evident from FIG. 1 that variability in the level of aluminum content over time occurred, and at least a part of this variability may be attributed to differences in the parameters of each run. For example, the low-impurity magnesium in Trial 2 had a higher starting level of aluminum and also used a lower dose of zirconium tetrachloride of 100 pounds (versus 155 pounds in Trial 2) for the 13,000 pounds of molten low-impurity magnesium in the holding vessel. The lower dose of zirconium tetrachloride used in Trial 2 resulted in a final concentration of 0.75 weight percent zirconium tetrachloride on the basis of the weight of the molten magnesium. Each of Trials 1-4 used an agitator to improve mixing of the materials. In spite of the variability in the reduction of aluminum content over time shown in FIG. 1, the data plotted in FIG. 1 clearly show the reduction in aluminum impurity, and the corresponding increase in magnesium purity, over time once an addition of zirconium-containing material has been made. Table 2 lists the measured aluminum levels at various times for Trials 1-4. Table 3 lists the initial (t=0) and final measured aluminum levels for Trials 1-4.

TABLE 2

| Trial 1 | | Trial 2 | | Trial 3 | | Trial 4 | |
|---|---|---|---|---|---|---|---|
| Time (minutes) | Al Content (ppm) | Time (minutes) | Al Content (ppm) | Time (minutes) | Al Content (ppm) | Time (minutes) | Al Content (ppm) |
| 0 | 120 | 0 | 146 | 0 | 101 | 0 | 89 |
| 10 | 58 | 10 | 130 | 10 | 76 | 10 | 67 |

TABLE 2-continued

| Trial 1 | | Trial 2 | | Trial 3 | | Trial 4 | |
|---|---|---|---|---|---|---|---|
| Time (minutes) | Al Content (ppm) | Time (minutes) | Al Content (ppm) | Time (minutes) | Al Content (ppm) | Time (minutes) | Al Content (ppm) |
| 20 | 82 | 20 | 122 | 20 | 79 | 20 | 63 |
| 30 | 73 | 30 | 139 | 30 | 75 | 30 | 72 |
| 40 | 73 | 40 | 125 | 40 | 68 | 40 | 68 |
| 50 | 70 | 50 | 113 | 50 | 70 | 50 | 60 |
| 60 | 68 | 60 | 107 | 60 | 64 | 60 | 66 |
| 67 | 61 | 90 | 95 | 140 | 64 | 80 | 65 |
| 82 | 59 | 120 | 90 | 150 | 53 | 90 | 67 |
| 97 | 59 | 150 | 77 | 175 | 55 | 103 | 62 |
| 127 | 41 | 180 | 73 | 185 | 61 | 125 | 65 |
| 147 | 35 | 190 | 63 | 205 | 58 | 143 | 66 |
| 162 | 30 | 200 | 64 | 232 | 60 | 163 | 66 |
| 177 | 25 | 215 | 59 | 252 | 56 | 180 | 65 |
| | | 235 | 57 | | | | |
| | | 250 | 58 | | | | |
| | | 270 | 52 | | | | |

TABLE 3

| Trial | Aluminum Level in Untreated Magnesium (ppm) | Aluminum Level in $ZrCl_4$-Treated Magnesium (ppm) |
|---|---|---|
| 1 | 120 | 25 |
| 2 | 146 | 52 |
| 3 | 101 | 56 |
| 4 | 89 | 65 |

In another experiment, molten magnesium was treated with zirconium tetrachloride according to the above-described non-limiting method embodiment and then cast into bars. Magnesium casts from various untreated batches, produced contemporaneously with the treated magnesium, were deliberately selected from inventory to define the lowest possible impurity levels present in the baseline (untreated) production process. Both the treated and the untreated magnesium received the same refining procedure with the same flux so as to eliminate any differences in the refining procedure between the treated and untreated samples. Unlike the methodology of Trials 1-4, the elemental analysis was not performed during the settling period but only on the final cast product. Seven samples, obtained by drilling the cast bars, were taken from the treated magnesium. Five drilled samples were taken from the untreated magnesium. The samples where chemically analyzed by inductively coupled plasma mass spectrometry (ICP-MS) for most elements except carbon, which was measured by combustion and infrared spectroscopy, and nitrogen, which was measured by Kjeldahl digestion. The impurity profiles for both sets of samples are summarized in Table 3. It is evident that the zirconium tetrachloride treatment significantly reduced the levels of aluminum, iron, nitrogen, and phosphorus impurities in the magnesium. In addition, this treatment did not alter the levels of boron and cadmium, the two elements most tightly controlled in nuclear-grade zirconium. Only manganese exhibited an increase that may have been attributable to the zirconium tetrachloride treatment, although the cause has not been determined with certainty at this time.

TABLE 3

| Element | Level in Untreated Magnesium (ppm unless noted otherwise) | Level in $ZrCl_4$-Treated Magnesium (ppm unless noted otherwise) |
|---|---|---|
| Al | 53 ± 2 | <30 |
| B | <0.7 | <0.7 |
| C | 28 ± 4 | <20 |
| Ca | <50 | <50 |
| Cd | <1 | <1 |
| Cu | <40 | <40 |
| Fe | 304 ± 9 | <100 |
| Mg | 99.92% | 99.94% |
| Mn | <40 | 50 ± 2 |
| N | 22 ± 6 | 5.9 ± 0.4 |
| Na | <50 | <50 |
| Ni | <10 | <10 |
| P | 26 ± 3 | 5.3 ± 0.8 |
| Pb | <50 | <50 |
| Si | <50 | <50 |
| Sn | <50 | <50 |
| Ti | <50 | <50 |
| Zr | N/A | 1214 ± 195 |

Considering the data shown in Tables 2 and 3, it is evident that the addition of dosages of zirconium tetrachloride to molten low-impurity magnesium substantially reduced the level of several impurities in the magnesium, resulting in a cast magnesium product having significantly improved chemical purity. As was expected, the zirconium level in the treated cast magnesium increased. However, an increase in zirconium content is immaterial, and in some cases is an advantage, if the magnesium is to be used in a process in which levels of zirconium may be tolerated in the magnesium. In particular, the increased zirconium content of the magnesium may provide an advantage in terms of an increase in zirconium metal yield when the purified magnesium is to be used as reductant in the production of zirconium metal by the Kroll process. As such, it is believed that the conventional specification limit for zirconium in magnesium intended for zirconium metal production may be increased significantly given that the presence of zirconium in the magnesium will not detract from the purity, and may improve the yield, of zirconium metal. Of course, the increased level of zirconium that may result from using a magnesium purification method according to the present disclosure may be problematic for uses of the magnesium in which zirconium is considered to be an undesirable impurity in the magnesium.

Certain non-limiting embodiments of a purified magnesium treated according to purification methods disclosed herein include greater than 1000 ppm zirconium. Also, certain embodiments of a purified magnesium product treated according to purification methods disclosed herein include greater than 1000 ppm up to 3000 ppm zirconium. Non-limiting embodiments of the purified magnesium also may include impurities such as, for example, any of the broad, preferred, or more preferred concentrations of impurities shown in the Table 4, in any combinations. All concentrations in Table 4 are in weight percentages.

TABLE 4

| Element | No more than | Preferably no more than | More preferably no more than |
|---|---|---|---|
| Al | 0.007 | 0.005 | 0.004 |
| B | 0.0001 | 0.00007 | 0.00005 |
| Cd | 0.002 | 0.0001 | 0.00005 |
| Hf | 0.01 | 0.005 | 0.003 |
| Fe | 0.06 | 0.04 | 0.03 |
| Mn | 0.01 | 0.008 | 0.006 |
| N | 0.005 | 0.004 | 0.003 |
| P | 0.005 | 0.004 | 0.003 |
| Ti | 0.02 | 0.01 | 0.005 |
| Si | 0.006 | 0.005 | 0.003 |
| Cu | 0.005 | 0.004 | 0.003 |
| Ni | 0.002 | 0.001 | 0.0007 |
| Ca | 0.008 | 0.007 | 0.005 |
| Sn | 0.006 | 0.005 | 0.003 |
| Pb | 0.006 | 0.005 | 0.003 |
| Na | 0.015 | 0.010 | 0.005 |

In certain non-limiting embodiments, a purified magnesium according to the present disclosure includes magnesium, zirconium, and no more than 0.1 weight percent of other elements. Certain embodiments of such a purified magnesium include greater than 1000 ppm zirconium or greater than 1000 up to 3000 ppm zirconium.

Figure 2:
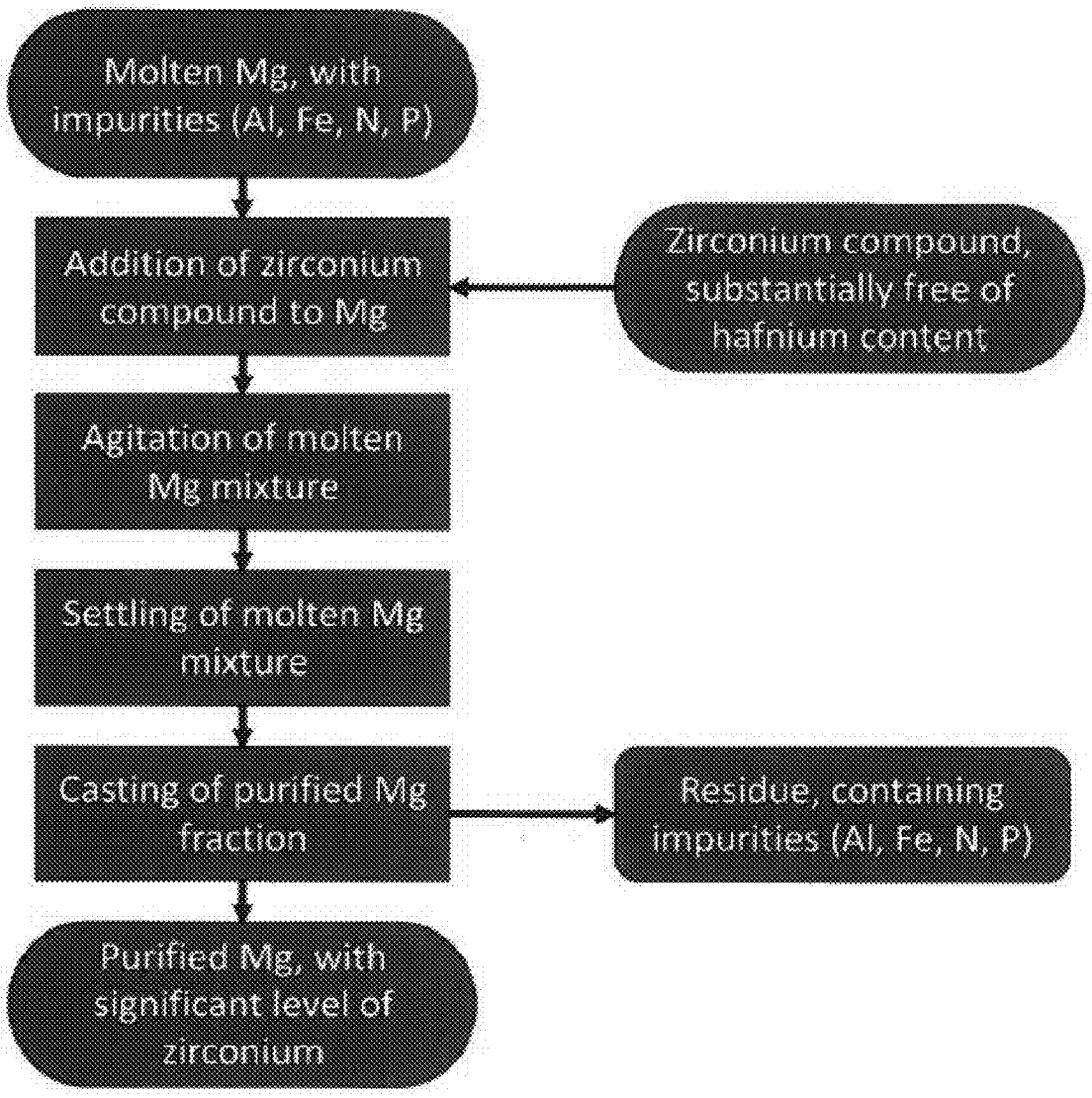
FIG. 2 is a flow chart depicting a non-limiting embodiment of a method for purifying magnesium according to the present disclosure.

FIG. 2 is a flow chart depicting a non-limiting embodiment of a method for purifying magnesium according to the present disclosure. In a first step, molten low-impurity magnesium comprising levels of impurities including aluminum, iron, nitrogen, and phosphorus is provided in a holding vessel. In a second step, a zirconium-containing material that is at least one of zirconium and a zirconium compound and that is substantially free of hafnium (i.e., that includes less than 100 ppm, and preferably less than 50 ppm, of hafnium) is added to the molten magnesium in the holding vessel. In a third step, the mixture of molten low-impurity magnesium and the zirconium-containing material is agitated to facilitate homogeneity and reaction of the zirconium with impurities in the molten magnesium to form intermetallic compounds. In a fourth step, the agitation is discontinued and the binary intermetallic compounds formed in the mixture are allowed to settle to a bottom region of the holding vessel. In a fifth step, the purified magnesium fraction of the molten mixture is cast and is separated from the residue in a bottom region of the holding vessel, which contains reacted impurities such as, for example, reacted aluminum, iron, nitrogen, and phosphorus. As shown in FIG. 2, the cast product is a purified magnesium including a significant level of zirconium.

Figure 3:
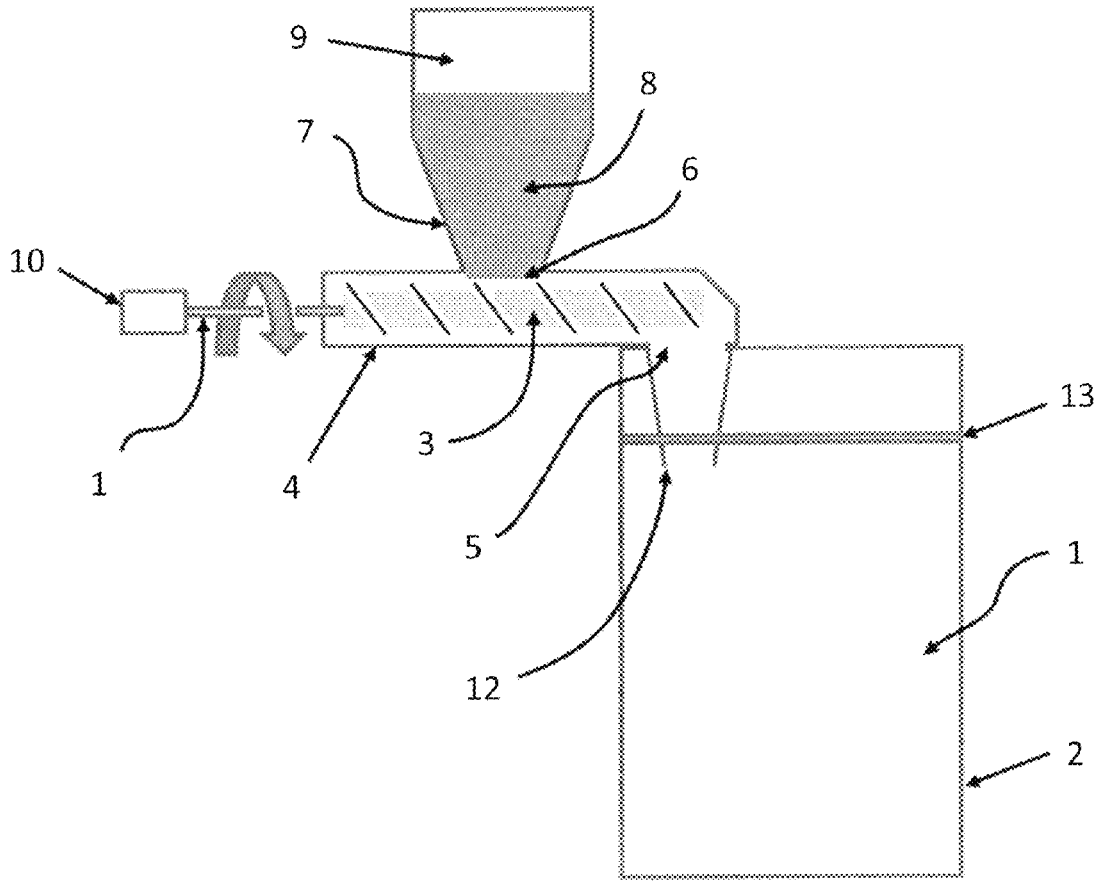
FIG. 3 is a schematic illustration of a non-limiting embodiment of an apparatus for conducting a method for purifying magnesium according to the present disclosure.

One non-limiting example of an apparatus for carrying out a method according to the present disclosure is schematically depicted in FIG. 3. A molten low-impurity magnesium (1) is disposed in a heated holding vessel (2). Although the holding vessel (2) is shown with a enclosed top, in other embodiments the holding vessel may or may not be enclosed at the top. For example, a top may be unnecessary if a cover gas and/or a flux are provided over the magnesium within the vessel to thereby prevent contact with ambient air. A material feed auger (3) is positioned within a generally horizontally disposed delivery pipe (4) that is connected with an opening (5) into the heated holding vessel (2). A cone-bottomed vessel (7) connects to an opening (6) on an upper region of the delivery pipe (4). A particulate zirconium containing material (8) such as, for example, one or more of zirconium and a zirconium compound, is disposed in the vessel (7). In one non-limiting embodiment, the zirconium-containing material is a powdered zirconium tetrachloride. The vessel (7) may include a headspace (9) above the zirconium-containing material (8) that is filled with an inert gas such as, for example, argon or nitrogen, to minimize exposure of the zirconium-containing material (8) to moisture and/or oxygen. The delivery pipe (4) likewise may be purged with an inert gas to prevent exposure of the zirconium-containing material (8) to moisture, which may cause clumping of the material within the delivery pipe (4). Zirconium-containing material (8) is introduced into the molten low-impurity magnesium (1) by activating a motor (10) to thereby rotate shaft (11) of the material feed auger (3). The rotational speed of the feed auger (3), and thus the delivery rate of the zirconium-containing material (8) into the molten magnesium (1), may be controlled. In certain non-limiting embodiments, the feed auger (3) may be rotated for discrete time intervals to compensate for feed pipe sizing, motor rating, and/or mixing considerations.

With further reference to the apparatus shown in FIG. 3, a funnel and/or a transfer pipe (12) may be used to better enable the zirconium-containing material to penetrate through any flux layer (13) that may be present on the top surface of the molten magnesium (1). Periodic cleaning (i.e., "rodding out") of the transfer pipe (4) may be carried out to better ensure unimpeded flow of zirconium-containing material through the transfer pipe (3) and into the holding vessel (2). The mixture of molten material in the holding vessel (2) may be agitated using conventional mixing/stirring means. In certain non-limiting embodiments, the agitation of the material in the holding vessel (2) may be conducted continuously both during and after the introduction of the zirconium-containing material (8) into the holding vessel (2). Once the mixture of molten low-impurity magnesium and zirconium-containing material has been allowed to react and intermetallic compounds have been formed from impurities and allowed to settle to a bottom region of the holding vessel (2), any suitable method may be used to separate the reacted impurities from the purified magnesium, which may be cast to a solid for uses such as, for example, zirconium metal production. As an example, a transfer pipe may be inserted into the molten magnesium, such that the tip of the pipe is located at an intermediate height within the vessel. This height is lower than the depth of the surface flux but higher than the position of the impurities at the bottom of the vessel. Once the pipe is suitably positioned, purified magnesium may be siphoned to a direct chill caster or other suitable casting station.

Those having ordinary skill, upon reading the present disclosure, will envision alternate arrangements for delivering a zirconium-containing material to a holding vessel containing a molten low-impurity magnesium and for otherwise carrying out embodiments of the magnesium purification methods according to the present disclosure. For example, in one non-limiting embodiment, a feed vessel including powdered zirconium tetrachloride or another zirconium-containing material may be situated above the holding vessel, and a star valve or other suitable valve disposed at a bottom of the feed vessel may be opened to deliver doses of the powdered material to a molten low-impurity magnesium disposed in the holding vessel. One possible disadvantage of such a design is that the zirconium-containing material may be subject to vaporization from heat radiating from the molten magnesium in the holding vessel. In yet another possible non-limiting embodiment of an apparatus for conducting a method according to the present disclosure, a chain conveyor may be utilized to deliver zirconium-containing material into the holding vessel. One possible disadvantage of such an embodiment is that the chain conveyer may be subject to failure at any of the numerous chain link points, disrupting the process of dosing molten low-impurity magnesium in the holding vessel with a zirconium-containing material being transported by the conveyor.

According to one embodiment of the present disclosure, a purified magnesium is provided including greater than 1000 ppm zirconium, magnesium, and incidental impurities. A purified magnesium according to the present disclosure may be used in any suitable application and, given its zirconium content, is particularly suited for use as reductant in a Kroll process for producing zirconium metal from zirconium tetrachloride. In one form, a purified magnesium according to the present disclosure consists essentially of greater than 1000 up to 3000 ppm zirconium, magnesium, and incidental impurities. In certain forms, the purified magnesium includes incidental impurities within the following ranges: 0 to 0.007 weight percent aluminum; 0 to 0.0001 weight percent boron; 0 to 0.002 weight percent cadmium; 0 to 0.01 weight percent hafnium; 0 to 0.06 weight percent iron; 0 to 0.01 weight percent manganese; 0 to 0.005 weight percent nitrogen; 0 to 0.005 weight percent phosphorus; and 0 to 0.02 weight percent titanium.

In another form, a purified magnesium according to the present disclosure consists of: greater than 1000 up to 3000 ppm zirconium, magnesium, and incidental impurities. In certain forms, the purified magnesium includes incidental impurities within the following ranges: 0 to 0.007 weight percent aluminum; 0 to 0.0001 weight percent boron; 0 to 0.002 weight percent cadmium; 0 to 0.01 weight percent hafnium; 0 to 0.06 weight percent iron; 0 to 0.01 weight percent manganese; 0 to 0.005 weight percent nitrogen; 0 to 0.005 weight percent phosphorus; and 0 to 0.02 weight percent titanium.

As discussed above, magnesium that has been processed and purified according to embodiments of the methods of the present disclosure may be used in any suitable application, and one such application is as reductant in a Kroll process for producing zirconium metal from zirconium tetrachloride. Those having ordinary skill will understand how to conduct a Kroll process to produce zirconium metal from zirconium tetrachloride. In one non-limiting embodiment of such a process wherein magnesium purified by an embodiment of the methods disclosed herein is used as reductant, cast purified magnesium is loaded into one chamber of a mild steel assembly, and zirconium tetrachloride powder is loaded into a separate chamber. The two chambers are connected with an open passage that permits vapors to travel therebetween. The entire assembly, including the two chambers and the communicating passage, is welded shut and maintained under a positive pressure of argon to exclude ambient humidity and oxygen. Separate heating zones within a furnace enable differential heating of the chambers. The magnesium is melted under argon, and the zirconium tetrachloride is sublimed such that the resulting zirconium tetrachloride vapor diffuses through the communicating passage to contact the molten magnesium. The zirconium tetrachloride and magnesium react and form reaction products including zirconium metal and magnesium chloride salt, which is less dense than the metal. Eventual cooling of the assembly and opening of the two chambers allows access to the metal and salt products, which may be separated by lifting the salt layer from the metal. The metal fraction may be distilled under vacuum to remove residual salt, and the resulting purified zirconium metal product includes porosity from vacancies left by removed magnesium chloride. The porous zirconium metal product may be referred to as zirconium sponge.

Accordingly, one aspect of the present disclosure is directed to a method of producing zirconium metal by a Kroll process in which magnesium reductant is reacted with zirconium tetrachloride, and wherein the magnesium reductant has been made using an embodiment of the magnesium purification process described herein. Another aspect of the present disclosure is directed to a method of producing zirconium metal by a Kroll process in which magnesium reductant is reacted with zirconium tetrachloride, and wherein the magnesium reductant has a composition as described herein that includes magnesium, incidental impurities, and greater than 1000 ppm or greater than 1000 up to 3000 ppm zirconium.

One non-limiting embodiment a method of producing zirconium metal according to the present disclosure includes the following steps: reacting zirconium tetrachloride with magnesium reductant to provide reaction products comprising zirconium metal and magnesium chloride salt, wherein the magnesium reductant comprises greater than 1000 up to 3000 ppm zirconium; and separating at least a portion of the zirconium metal from the reaction products. In certain non-limiting embodiments of the method, the magnesium reductant either consists essentially of or consists of: greater than 1000 up to 3000 ppm zirconium; magnesium; 0 to 0.007 weight percent aluminum; 0 to 0.0001 weight percent boron; 0 to 0.002 weight percent cadmium; 0 to 0.01 weight percent hafnium; 0 to 0.06 weight percent iron; 0 to 0.01 weight percent manganese; 0 to 0.005 weight percent nitrogen; 0 to 0.005 weight percent phosphorus; and 0 to 0.02 weight percent titanium. In certain non-limiting embodiments of the method, the step of reacting zirconium tetrachloride with magnesium reductant to provide reaction products comprises melting the magnesium reductant in a first chamber and subliming the zirconium tetrachloride in a second chamber, and allowing zirconium tetrachloride vapors to contact and react with the molten magnesium and produce the reaction products. In certain embodiments of the method, the reaction products comprise a layer consisting primarily of zirconium metal and a layer consisting primarily of magnesium chloride salt, and the two layers may be separated. The separated layer including primarily zirconium metal is distilled under vacuum to remove residual salt, and the zirconium product is zirconium sponge including porosity from vacancies left by removed magnesium chloride.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth herein. Such embodiments may be obtained, for example, by combining, modifying, or reorganizing any of the disclosed steps, components, elements, features, aspects, characteristics, limitations, and the like, of the various non-limiting embodiments described in this specification. In this manner, Applicant reserves the right to amend the claims during prosecution to add features as variously described in this specification, and such amendments comply with the requirements of 35 U.S.C. §112, first paragraph, and 35 U.S.C. §132(a).

What is claimed is:

1. A method for reducing impurities in magnesium, the method comprising:

combining a zirconium-containing material with a molten low-impurity magnesium including no more than 1.0 weight percent of total impurities in a vessel to provide a mixture;

holding the mixture in a molten state for a period of time sufficient to allow at least a portion of the zirconium-containing material to react with at least a portion of the impurities and form intermetallic compounds; and separating at least a portion of the molten magnesium in the mixture from at least a portion of the intermetallic compounds to provide a purified magnesium, wherein the purified magnesium includes an increased level of zirconium compared to the low-impurity magnesium, wherein the level of zirconium in the purified magnesium is greater than 1000 ppm zirconium, and wherein the purified magnesium includes a reduced level of impurities other than zirconium compared to the low-impurity magnesium.

2. The method of claim 1, wherein the low-impurity magnesium includes no more than 0.5 weight percent of other elements.

3. The method of claim 1, wherein the low-impurity magnesium includes no more than 0.3 weight percent of other elements.

4. The method of claim 1, wherein the low-impurity magnesium includes no more than 0.02 weight percent aluminum.

5. The method of claim 1, wherein the zirconium-containing material comprises at least one of zirconium metal and a zirconium-based compound.

6. The method of claim 1, wherein the zirconium-containing material comprises a zirconium-based compound including one or more metallic elements and one or more non-metallic elements, and wherein the metallic elements in the zirconium-based compound comprise more than 90% zirconium by weight.

7. The method of claim 1, wherein the zirconium-containing material comprises at least one of zirconium tetrachloride, zirconium oxide, zirconium nitride, zirconium sulfate', zirconium tetrafluoride, $Na_2ZrCl_6$, and $K_2Z_rCl_6$.

8. The method of claim 1, wherein the zirconium-containing material comprises nuclear-grade zirconium.

9. The method of claim 8, wherein the nuclear grade zirconium comprises: at least 99.5 weight percent zirconium; 0 to 100 ppm hafnium; 0 to 250 ppm carbon; 0 to 1400 ppm oxygen; 0 to 50 ppm nitrogen; 0 to 1300 ppm chlorine; 0 to 75 ppm aluminum; 0 to 0.5 ppm boron; 0 to 0.5 cadmium ppm; 0 to 20 ppm cobalt; 0 to 30 ppm copper; 0 to 200 ppm chromium; 0 to 1500 ppm iron; 0 to 50 ppm manganese; 0 to 50 ppm molybdenum; 0 to 70 ppm nickel; 0 to 120 ppm silicon; 0 to 50 ppm titanium; 0 to 50 ppm tungsten; and 0 to 3 ppm uranium.

10. The method of claim 1, wherein the zirconium-containing material comprises nuclear-grade zirconium tetrachloride.

11. The method of claim 10, wherein the nuclear grade zirconium tetrachloride comprises the following levels of impurities, wherein the impurities concentrations are calculated relative to the zirconium content in the zirconium tetrachloride: 0 to 100 ppm hafnium; 0 to 250 ppm carbon; 0 to 1400 ppm oxygen; 0 to 50 ppm nitrogen; 0 to 75 ppm aluminum; 0 to 0.5 ppm boron; 0 to 0.5 cadmium ppm; 0 to 20 ppm cobalt; 0 to 30 ppm copper; 0 to 200 ppm chromium; 0 to 1500 ppm iron; 0 to 50 ppm manganese; 0 to 50 ppm molybdenum; 0 to 70 ppm nickel; 0 to 120 ppm silicon; 0 to 50 ppm titanium; 0 to 50 ppm tungsten; and 0 to 3 ppm uranium.

12. The method of claim 1, comprising holding the mixture in a molten state for at least 30 minutes to allow the zirconium-containing compound to react with the impurities and form intermetallic compounds.

13. The method of claim 1, comprising holding the mixture in a molten state for up to 100 minutes to allow the zirconium-containing compound to react with the impurities and form intermetallic compounds.

14. The method of claim 1, comprising holding the mixture in a molten state for 30 minutes to 100 minutes to allow the zirconium-containing compound to react with the impurities and form intermetallic compounds.

15. The method of claim 1, further comprising enhancing homogeneity of the mixture.

16. The method of claim 15, comprising inducing convection currents in the mixture.

17. The method of claim 16, wherein convection currents are induced in the mixture by at least one of heating a lower zone of the mixture in the vessel and cooling an upper zone of the mixture in the vessel.

18. The method of claim 1, wherein the purified magnesium includes no more than 0.10 weight percent of elements other than magnesium and zirconium.

19. The method of claim 1, wherein the purified magnesium includes no more than 0.007 weight percent aluminum.

20. The method of claim 1, wherein the purified magnesium includes no more than 0.0001 weight percent boron.

21. The method of claim 1, wherein the purified magnesium includes no more than 0.002 weight percent cadmium.

22. The method of claim 1, wherein the purified magnesium includes no more than 0.01 weight percent hafnium.

23. The method of claim 1, wherein the purified magnesium includes no more than 0.06 weight percent iron.

24. The method of claim 1, wherein the purified magnesium includes no more than 0.01 weight percent manganese.

25. The method of claim 1, wherein the purified magnesium includes no more than 0.005 weight percent nitrogen.

26. The method of claim 1, wherein the purified magnesium includes no more than 0.005 weight percent phosphorus.

27. The method of claim 1, wherein the purified magnesium includes no more than 0.02 weight percent titanium.

28. The method of claim 1, wherein the purified magnesium includes greater than 1000 ppm up to 3000 ppm zirconium.

29. The method of claim 1, wherein the purified magnesium includes:

no more than 0.007 weight percent aluminum;
no more than 0.0001 weight percent boron;
no more than 0.002 weight percent cadmium;
no more than 0.01 weight percent hafnium;
no more than 0.06 weight percent iron;
no more than 0.01 weight percent manganese;
no more than 0.005 weight percent nitrogen;
no more than 0.005 weight percent phosphorus;
no more than 0.02 weight percent titanium; and
greater than 1000 ppm zirconium.

30. The method of claim 29, wherein the purified magnesium includes greater than 1000 ppm up to 3000 ppm zirconium.

31. The method of claim 1, wherein the vessel is one of a covered mild steel tank and uncovered mild steel tank.

32. The method of claim 31, wherein the steel tank has a liquid capacity of at least 1000 gallons.

33. The method of claim 1, wherein the zirconium-containing material is a solid that is one of a particulate material, a powder, turnings, and a foil.

34. The method of claim 1, wherein the zirconium-containing material is in the form of particles less than 80 mesh.

35. The method of claim 1, wherein in the holding step the intermetallic compounds formed by reaction between zirconium and impurities comprise binary intermetallic compounds.

36. The method of claim 35, wherein the binary intermetallic compounds comprise at least one of $Zr_4Al_3$, $ZrFe_2$, and $ZrMn_2$.

37. The method of claim 1, wherein at least a portion of the intermetallic compounds sink in the molten magnesium to a bottom region of the vessel.

38. The method of claim 1, wherein molten magnesium in an upper region of the vessel is separated from material including intermetallic compounds in a lower region of the vessel.

39. A method for reducing impurities in magnesium, the method comprising:

combining at least one zirconium-containing material selected from zirconium metal, zirconium tetrachloride, zirconium oxide, zirconium nitride, zirconium sulfate, zirconium tetrafluoride, $Na_2ZrCl_6$, and $K_2ZrCl_6$ with a molten low-impurity magnesium including no more than 1.0 weight percent of total impurities in a vessel to provide a mixture;

holding the mixture in a molten state for at least 30 minutes to allow at least a portion of the zirconium-containing material to react with at least a portion of the impurities and form intermetallic compounds; and separating at least a portion of the molten magnesium in the mixture from at least a portion of the intermetallic compounds to provide a purified magnesium, wherein the purified magnesium includes a reduced level of impurities other than zirconium compared to the low-impurity magnesium and greater than 1000 ppm zirconium.

40. The method of claim 39, wherein the low-impurity magnesium includes no more than 0.02 weight percent aluminum.

41. The method of claim 39, wherein the zirconium-containing material comprises nuclear-grade zirconium including: at least 99.5 weight percent zirconium; 0 to 100 ppm hafnium; 0 to 250 ppm carbon; 0 to 1400 ppm oxygen; 0 to 50 ppm nitrogen; 0 to 1300 ppm chlorine; 0 to 75 ppm aluminum; 0 to 0.5 ppm boron; 0 to 0.5 cadmium ppm; 0 to 20 ppm cobalt; 0 to 30 ppm copper; 0 to 200 ppm chromium; 0 to 1500 ppm iron; 0 to 50 ppm manganese; 0 to 50 ppm molybdenum; 0 to 70 ppm nickel; 0 to 120 ppm silicon; 0 to 50 ppm titanium; 0 to 50 ppm tungsten; and 0 to 3 ppm uranium.

42. The method of claim 39, wherein the zirconium-containing material comprises zirconium tetrachloride including the following levels of impurities, wherein the impurities concentrations are calculated relative to the zirconium content in the zirconium tetrachloride: 0 to 100 ppm hafnium; 0 to 250 ppm carbon; 0 to 1400 ppm oxygen; 0 to 50 ppm nitrogen; 0 to 75 ppm aluminum; 0 to 0.5 ppm boron; 0 to 0.5 cadmium ppm; 0 to 20 ppm cobalt; 0 to 30 ppm copper; 0 to 200 ppm chromium; 0 to 1500 ppm iron; 0 to 50 ppm manganese; 0 to 50 ppm molybdenum; 0 to 70 ppm nickel; 0 to 120 ppm silicon; 0 to 50 ppm titanium; 0 to 50 ppm tungsten; and 0 to 3 ppm uranium.

43. The method of claim 39, comprising holding the mixture in a molten state for at least 30 minutes up to 100 minutes to allow the zirconium-containing compound to react with the impurities and form intermetallic compounds.

44. The method of claim 39, wherein the purified magnesium includes no more than 0.10 weight percent of elements other than magnesium and zirconium.

45. The method of claim 44, wherein the purified magnesium includes greater than 1000 ppm up to 3000 ppm zirconium.

46. The method of claim 39, wherein the purified magnesium includes:

no more than 0.007 weight percent aluminum;
no more than 0.0001 weight percent boron;
no more than 0.002 weight percent cadmium;
no more than 0.01 weight percent hafnium;
no more than 0.06 weight percent iron;
no more than 0.01 weight percent manganese;
no more than 0.005 weight percent nitrogen;
no more than 0.005 weight percent phosphorus;
no more than 0.02 weight percent titanium; and
greater than 1000 ppm zirconium.

47. The method of claim 46, wherein the purified magnesium includes greater than 1000 ppm up to 3000 ppm zirconium.

* * * * *